US006164274A

United States Patent [19]

Giebeler et al.

[11] Patent Number: 6,164,274

[45] **Date of Patent: *Dec. 26, 2000**

[54] APPARATUS AND METHOD FOR HEATING FLUID

[76] Inventors: James F. Giebeler; Norman B. Giebeler, both of 1443 S. Gage St., San Bernardino, Calif. 92408

[ * ] Notice: This patent is subject to a terminal disclaimer.

[21] Appl. No.: 09/288,912

[22] Filed: Apr. 9, 1999

Related U.S. Application Data

[63] Continuation of application No. 09/112,441, Jul. 9, 1998, Pat. No. 5,931,153.

[51] Int. Cl.[7] ..... F24C 9/00

[52] U.S. Cl. ..... 126/247; 122/26

[58] Field of Search ..... 126/247; 237/12.3 B, 237/1 R; 122/26

[56] References Cited

U.S. PATENT DOCUMENTS

| | | | |
|---|---|---|---|
| 1,034,184 | 7/1912 | Alberger . | |
| 1,183,939 | 5/1916 | Whittelsey . | |
| 1,758,207 | 5/1930 | Walker . | |
| 2,312,996 | 3/1943 | Bethenod . | |
| 2,316,522 | 4/1943 | Loeffler . | |
| 2,451,873 | 10/1948 | Roebuck . | |
| 2,988,266 | 6/1961 | Hughes . | |
| 2,991,764 | 7/1961 | French . | |
| 3,164,147 | 1/1965 | Love et al. . | |
| 3,198,191 | 8/1965 | Wyszomivsk . | |
| 3,508,402 | 4/1970 | Gray . | |
| 3,690,302 | 9/1972 | Rennolds . | |
| 3,720,372 | 3/1973 | Jacobs . | |
| 3,791,167 | 2/1974 | Eskeli . | |
| 3,791,349 | 2/1974 | Schaefer . | |
| 3,793,848 | 2/1974 | Eskeli . | |
| 4,004,553 | 1/1977 | Stenstrom . | |
| 4,143,639 | 3/1979 | Frenete . | |
| 4,277,020 | 7/1981 | Grenler . | |
| 4,381,762 | 5/1983 | Ernst . | |
| 4,779,575 | 10/1988 | Perkins . | |
| 4,781,151 | 11/1988 | Wolpert, Jr. et al. . | |
| 5,188,090 | 2/1993 | Griggs . | |
| 5,385,298 | 1/1995 | Griggs . | |
| 5,816,236 | 10/1998 | Moroi et al. | 126/247 |
| 5,842,636 | 12/1998 | Moroi et al. | 126/247 |
| 5,881,953 | 3/1999 | Moroi et al. | 126/247 |
| 5,931,153 | 8/1999 | Giebeler et al. | 126/247 |

*Primary Examiner*—Ira S. Lazarus
*Assistant Examiner*—Josiah C. Cocks
*Attorney, Agent, or Firm*—Lyon & Lyon LLP

[57] ABSTRACT

A method and apparatus for heating fluid comprising a rotor with a first hole and a second hole. The apparatus comprising an intake port, a discharge port and a pocket spaced apart from the rotor. The fluid enters the apparatus through the intake port and the rotor rotates causing the fluid to flow through the first hole, collide with the pocket, flow though the second hole and leave the apparatus through the discharge port.

19 Claims, 2 Drawing Sheets

APPARATUS AND METHOD FOR HEATING FLUID

This application is a continuation of U.S. patent application Ser. No. 09/112,441, filed Jun. 9, 1998 now U.S. Pat. No. 5,931,153.

FIELD OF THE INVENTION

The present invention relates generally to the field of heat generation and, more particularly, to heating fluid through mechanical means.

BACKGROUND OF THE INVENTION

Various heat generators have been designed and used in the past. The designs are quite diverse. During the past decades, many designers have developed devices to convert electrical energy through mechanical means for heating fluids. Some designs require separate pumps, while other designs utilize rotating devices, such as disks, paddles or drums.

Amongst the methods of generating heat, none is as well known as the friction method. In a device utilizing this method of heat generation, the amount of heat that can be generated is limited by the friction coefficient of the specific fluid and the rubbing surfaces of the heat generator.

Some heat generators utilize gas compression techniques to generate heat. But, such devices are quite inefficient for the amount of heat that can be generated is considerably small in comparison with the energy consumed by the device.

Other devices generate heat by a method called shearing. These devices generate heat by shearing or cutting the fluid by moving blades. Yet, other heat generators generate heat by pressurizing and forcing the fluid through small openings. Some other heat generators take advantage of a phenomenon called agitation, in which heat is generated when the fluid collides with surfaces within the heat generator.

However, these heat generators suffer from a variety of problems. For example, the present heat generators are inefficient, can be easily clogged, are too expensive to manufacture and/or are too large for their applications.

It is therefore, an object of the present invention to provide a new heat generator and method of generating heat that can improve the above shortcomings and more.

SUMMARY OF THE INVENTION

The present invention is directed to a method and to an apparatus for generating heat.

In a first separate aspect, the present invention is directed to a heat generator comprising a rotor that includes an intake port, a plurality of inner holes which surround the intake port and a plurality of outer holes that are located beyond the inner holes. The heat generator further comprises a front rotor housing for housing the rotor. The front rotor housing includes a plurality of pockets and a discharge port. The fluid enters the heat generator through the intake port. The rotor rotates and forces the fluid through the inner holes causing the fluid collide with the pockets and return through the outer holes and flow out of the heat generator through the discharge port.

In a second separate aspect, the present invention is directed to the above-described heat generator wherein a ring separates the inner holes and the outer holes.

In a third separate aspect, the present invention is directed to the above-described heat generator wherein the heat generator also comprises a rear rotor housing similar to the front rotor housing.

In a fourth separate aspect, the present invention is directed to a method of generating heat by following the steps of providing a rotor with an intake port, a plurality of inner holes and a plurality of outer holes beyond the inner holes. In the next step, the rotor is housed in a front rotor housing, wherein the front rotor housing has a plurality of pockets and a discharge port. Next, the fluid is directed to the intake port, the rotor rotates and forces the fluid out of the inner holes, the fluid collides with the pockets and the fluid returns through the outer holes. Lastly, the heated fluid is discharged through the discharge port.

Accordingly, it is an object of the present invention to heat fluid through such means. Other and further objects and advantages will appear hereinafter.

DETAILED DESCRIPTION OF THE PREFERRED EMBODIMENT

Figure 1:
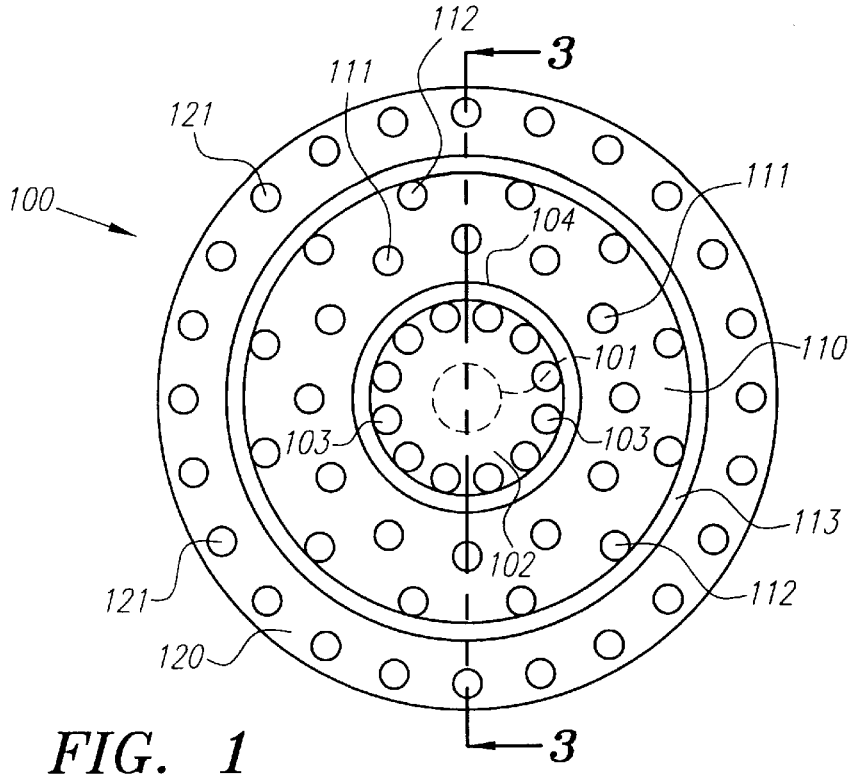
FIG. 1 is a perspective view of a rotor used in a preferred heat generator of the present invention.

Turning in detail to the preferred embodiment, a system and a method are disclosed which provide for heating fluid through mechanical means. FIG. 1 illustrates a perspective view of a rotor 100 in a preferred heat generator 300 of the present invention.

As shown, the rotor 100 is preferably circular and is divided into three distinct sections by an inner ring 104 and an outer ring 113. The area between the rotor/intake hole 101 and the inner ring 104 is called the inner space 102. The area between the inner ring 104 and the outer ring 113 is the intermediate space 110. The outer space 120 is the area beyond the outer ring 113.

The rotor 100 also includes a plurality of holes 103, 112 and 121 in each space 102, 110 and 120, respectively. The holes 103, 112 and 121 are for the purpose of allowing the fluid to flow through the rotor 100, as discussed later.

Figure 2:
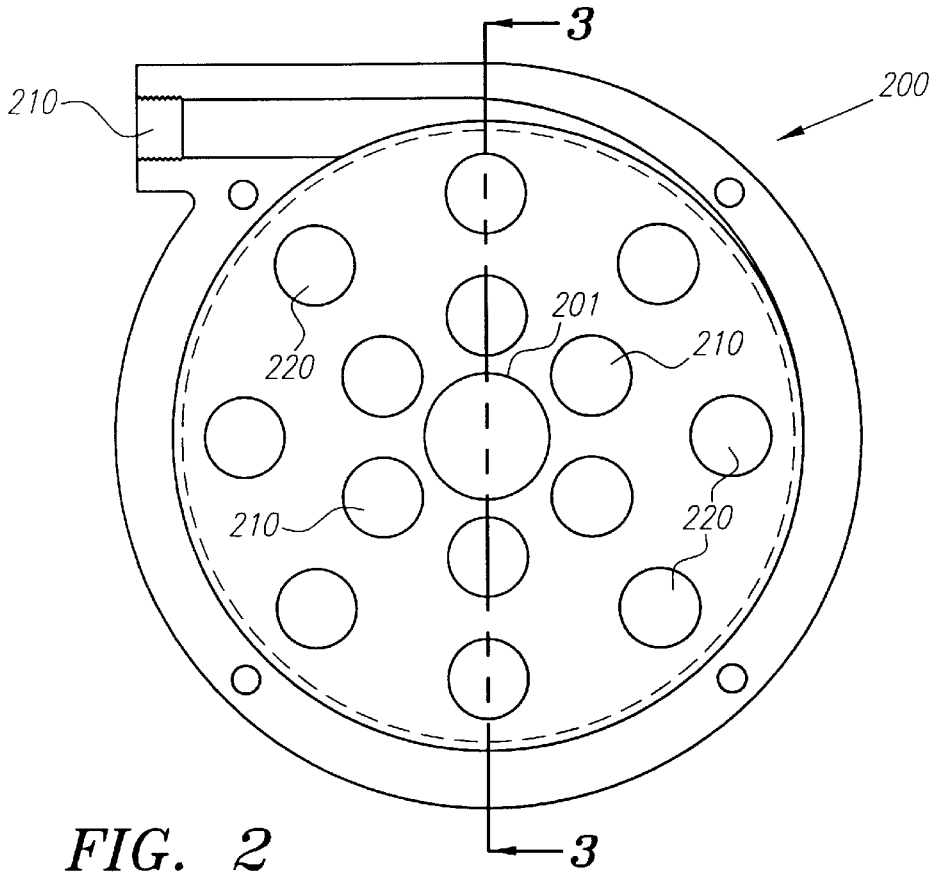
FIG. 2 is a perspective view of a housing for the rotor shown in FIG. 1.

Turning to FIG. 2, a front rotor housing 200 is shown. The rotor housing 200 is a circular housing with a housing intake hole 201 which corresponds to the intake hole 101 of the rotor 100. The front rotor housing 200 also includes a plurality of inner pockets 210 and a plurality of outer pockets 220 for receiving the fluid from the rotor 100.

Tangential to the outer edge of the front rotor housing 200 is a discharge port 210 for discharging the heated fluid. The front rotor housing 200 and a symmetrical rear rotor housing 250 house the rotor 100.

Figure 3:
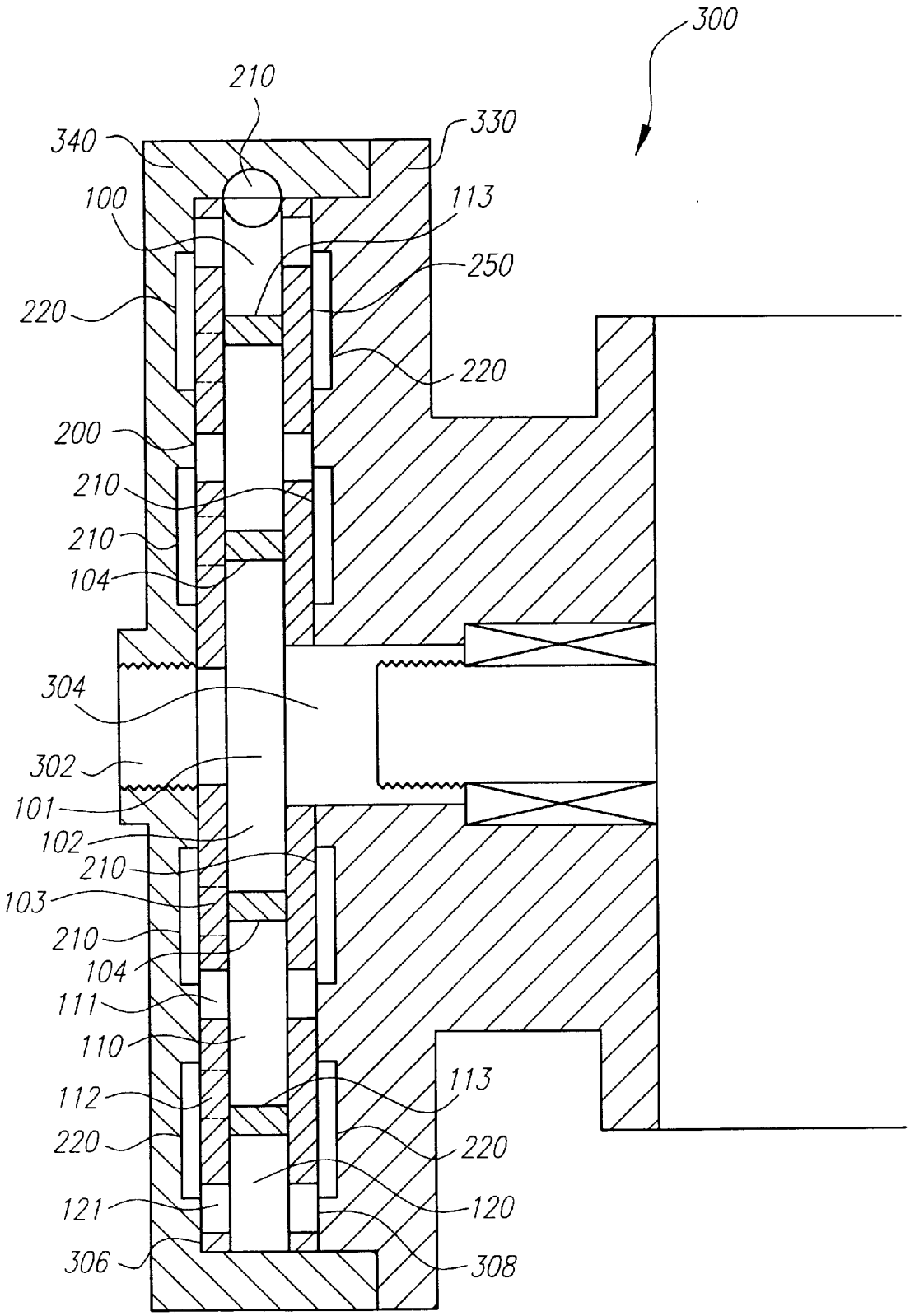
FIG. 3 is a section view of the preferred heat generator taken along the lines labeled with the numeral "3" of FIGS. 1 and 2.

Now, referring to FIG. 3, a preferred heat generator 300 of the present invention is illustrated. As shown, the heat generator 300 includes a motor housing 330 for enclosing a motor (not shown) and a discharge housing 340 for enclosing the rotor 100, the front rotor housing 200 and the rear rotor housing 250.

The heating process begins when the fluid enters the heat generator 300 through an intake port 302. The incoming fluid flows through the housing intake hole 201 and the rotor intake hole 101. Concurrently, an electrically powered hub spinner 304 rotates the rotor 100 inside the front and rear rotor housings 200 and 250. As a result of the rotation, the incoming fluid flows circumferentially into the inner space 102 between an intake plate 306 and a hub plate 308. Due to the centrifugal force created by the rotating rotor 100, the fluid flows circumferentially toward the inner ring 104. The rotation of the rotor 100 forces the fluid to flow radially through the inner holes 103 of the rotor where the fluid collides and is sheared by the inner pockets 210 of the front and rear rotor housings 200 and 250. The act of collision and agitation causes the fluid temperature to rise.

As a result of the rotation, some fluid also flows to the space between the rotor 100 and the discharge housing 340 causing further rise in temperature. Likewise, some fluid flows into the space between the rotor 100 and the motor housing 330 causing further agitation and heat.

The heated fluid returns through the intermediate holes 111 into the intermediate space 110. Once again, due to the centrifugal force of the rotation, the fluid flows circumferentially toward the outer ring 113. Eventually, the fluid is forced out of the intermediate holes 112. The fluid leaves the intermediate holes 112 and collides with and is sheared by the outer pockets 220 of the front and rear motor housings 200 and 250. Additional heat is generated as a result of this collision, shearing and friction.

After colliding with the outer pockets 220, the heated fluid returns through the outer holes 121 and flows circumferentially into the outer space 120 and from there into the discharge port 210 that is tangential to the outer edge of the rotor 100.

It should be apparent to one of ordinary skill in the art that the process described above may be repeated radially by adding more rings on the rotor 100 and more pockets on the housings in order to cause more agitation and heat. The process may also be repeated in parallel by adding side-by-side rotors that will result in increasing the volume of the fluid intake.

According to this process, the fluid is heated by molecular agitation and more rapidly than methods that rely solely on friction, shearing or compression.

Another advantage of the heat generator 300 is its simplicity. With only one moving part, i.e., the rotor 100, the heat generator 300 can be manufactured very economically, since the manufacturing process can take advantage of casting and stamping. For the same reason, the heat generator 300 is more reliable and can be easily maintained.

A further advantage of the heat generator 300 is that there is little opportunity for lime build-up or clogging since the holes 103, 112 and 121 are sufficiently large and there are no small passages. The heat generator 100 is not subject to cavitation as well, because it has no lifting surface, blade or paddle. Also, due to the efficiency of the heat generator 100, it is small in size.

Because of its small size, the heat generator 100 may be used as a spa heater. Traditional spas require both electrical power for circulating the water and natural gas for heating. The heat generator 100, however, requires only electricity because, as described above, the heat is generated by circulation. For this reason, the heat generator 100 is also environmentally safer than the traditional spas that use burners for heating the water.

Another advantage of the heat generator 100 is its lack of need for a storage tank. The heat generator 100 does not require a storage tank because it can heat the fluid very rapidly, therefore, it does not need to hold the heated water for future use. At the same time, no energy is wasted for maintaining the fluid temperature in the tank.

Accordingly, a heat generator and a process of generating heat are presented. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A heat generator for heating fluid, said heat generator comprising:

an intake port;

a rotor having a first hole and a second hole;

a front pocket spaced apart from said rotor; and a discharge port;

wherein said fluid enters through said intake port and said rotor rotates causing said fluid to flow through said first hole, collide with said front pocket, flow through said second hole and leave through said discharge port.

2. The heat generator of claim 1, wherein said second hole is farther from said intake port than said first hole.

3. The heat generator of claim 1, wherein said rotor further includes a first ring separating said first hole from said second hole.

4. The heat generator of claim 1, further comprising a rear pocket spaced apart from said rotor, wherein a portion of said fluid flowing through said first hole collides with said rear pocket, flows through said second hole and leaves through said discharge port.

5. A heat generator for heating fluid, said heat generator comprising:

an intake port;

a rotor having a first hole, a second hole, a third hole and a fourth hole;

a first front pocket and a second front pocket spaced apart from the rotor; and a discharge port;

wherein said fluid enters through said intake port and said rotor rotates causing said fluid to flow through said first hole, collide with said first front pocket, flow through said second hole, flow through said third hole, collide with said second front pocket, flow through said fourth hole and leave through said discharge port.

6. The heat generator of claim 5, wherein said second hole is farther from said intake port than said first hole, said third hole is farther from said intake port than said second hole, and said fourth hole is farther from said intake port than said third hole.

7. The heat generator of claim 5, wherein said rotor further includes a first ring separating said first hole from said second hole.

8. The heat generator of claim 7, wherein said rotor further includes a second ring separating said second hole from said third hole.

9. The heat generator of claim 8, wherein said rotor further includes a third ring separating said third hole from said fourth hole.

10. The heat generator of claim 7, wherein said rotor further includes a second ring separating said third hole from said fourth hole.

11. The heat generator of claim 7, further comprising a rear pocket spaced apart from said rotor, wherein a portion of said fluid flowing through said first hole collides with said rear pocket, flows through said second hole and leaves through said discharge port.

12. The heat generator of claim 11, wherein said rotor further includes a first ring separating said first hole from said second hole.

13. The heat generator of claim 12, wherein said rotor further includes a second ring separating said second hole from said third hole.

14. The heat generator of claim 13, wherein said rotor further includes a third ring separating said third hole from said fourth hole.

15. The heat generator of claim 12, wherein said rotor further includes a second ring separating said third hole from said fourth hole.

16. A method of heating fluid, said method comprising steps of:

providing an intake port, a discharge port and a rotor having a first hole and a second hole;

spacing apart from said rotor a first pocket;

guiding said fluid through said intake port;

rotating said rotor causing said fluid to flow through said first hole, collide with said pocket and flow through said second hole; and discharging said fluid through said discharge port.

17. The method of claim 16, further comprising a step of spacing apart from said rotor a second pocket, wherein said rotor further including a third hole and a fourth hole, and wherein said step of rotating further causes said fluid flowing through said second hole to flow through said third hole, collide with said second pocket and flow through said fourth hole.

18. The method of claim 16, wherein said rotor further has a ring separating said first hole from said second hole.

19. The method of claim 17, wherein said rotor further has a first ring separating said first hole from said second hole, and a second ring separating said third hole from said fourth hole.

* * * * *